US008235155B2

(12) United States Patent
Seegert et al.

(10) Patent No.: US 8,235,155 B2
(45) Date of Patent: Aug. 7, 2012

(54) RADIATOR MOUNTING ARRANGEMENT ON UTILITY VEHICLE

(75) Inventors: Brian D. Seegert, Hartford, WI (US); Stephan R. Hayden, Sun Prairie, WI (US); Brent L. Streeter, Clarksville, TN (US)

(73) Assignee: Deere & Company, Moline, IL (US)

( * ) Notice: Subject to any disclaimer, the term of this patent is extended or adjusted under 35 U.S.C. 154(b) by 253 days.

(21) Appl. No.: 12/476,463

(22) Filed: Jun. 2, 2009

(65) Prior Publication Data

US 2010/0300783 A1 Dec. 2, 2010

(51) Int. Cl.
*B60K 11/04* (2006.01)

(52) U.S. Cl. ..... 180/68.4; 165/67; 248/218.2

(58) Field of Classification Search ..... 248/218.1, 248/218.2, 503, 509; 180/68.4; 165/67, 165/148, 149

See application file for complete search history.

(56) References Cited

U.S. PATENT DOCUMENTS

| | | | | |
|---|---|---|---|---|
| 3,121,467 | A | 2/1964 | Bryant | |
| 3,123,170 | A | 3/1964 | Bryant | |
| 3,700,061 | A | 10/1972 | Hortnagl | |
| 3,929,201 | A | 12/1975 | Hoffman | |
| 4,121,682 | A | 10/1978 | Schaal et al. | |
| 4,139,053 | A | 2/1979 | Schaal | |
| 4,196,774 | A | 4/1980 | Hoffmann | |
| 4,417,635 | A * | 11/1983 | Thepault | 180/68.4 |
| 4,564,168 | A | 1/1986 | Ikuta et al. | |
| 4,604,015 | A | 8/1986 | Lesniak | |
| 4,651,839 | A | 3/1987 | Isobe | |
| 4,742,881 | A | 5/1988 | Kawaguchi et al. | |
| 4,773,496 | A | 9/1988 | Brielmair | |
| 5,291,961 | A | 3/1994 | Attinger et al. | |
| 5,558,310 | A | 9/1996 | Furuie et al. | |
| 5,605,200 | A | 2/1997 | Mayberry et al. | |
| 6,260,609 | B1 | 7/2001 | Takahashi | |
| 6,412,581 | B2 | 7/2002 | Enomoto et al. | |
| 6,550,558 | B2 | 4/2003 | Yorwarth et al. | |
| 6,675,921 | B2 | 1/2004 | Brown | |
| 6,827,169 | B1 * | 12/2004 | Van Hout et al. | 180/68.5 |
| 2002/0056541 | A1 * | 5/2002 | Kokubunji et al. | 165/67 |

* cited by examiner

*Primary Examiner* — Jeffrey J Restifo
*Assistant Examiner* — Erez Gurari

(57) ABSTRACT

A radiator mounting arrangement on a utility vehicle with an injection molded top tank and bottom tank, the top tank having a plurality of integrally molded features extending upwardly therefrom. A wire form is attached to a frame member of the utility vehicle and engages the integrally molded features without fasteners.

12 Claims, 3 Drawing Sheets

RADIATOR MOUNTING ARRANGEMENT ON UTILITY VEHICLE

FIELD OF THE INVENTION

This invention relates to radiators in automotive vehicles, and more specifically to a radiator mounting arrangement on an off-road utility vehicle.

BACKGROUND OF THE INVENTION

Radiators for automotive engine cooling systems typically are mounted between an upper and a lower vehicle frame member using a pair of resilient mounts. The radiator typically includes a top tank, bottom tank, and a core. Resilient mounts may be used because the radiator may be subject to vibrations, high forces and shocks during normal use due to jolts, accelerations or decelerations of the vehicle as it is driven over rugged terrain. Additionally, a radiator may be subject to thermal expansion with respect to the vehicle frame, and tolerances may vary between the radiator and frame members that can affect assembly.

Examples of radiator mounting arrangements are found in the following issued patents:

U.S. Pat. No. 6,260,609 for Radiator Attachment Structure and U.S. Pat. No. 6,412,581 for Radiator Mounting Structure relate to a bracket which is a flat plate-like member with one end attached to an upper cross member of the vehicle frame, and the other end having a hole for a pin on the upper end of the radiator.

U.S. Pat. No. 4,651,839 for Radiator Supporting Device relates to an elastomeric support that holds the pin or post on the radiator base.

U.S. Pat. No. 5,605,200 for Self Attaching Upper Radiator Mount relates to a one piece molded rubber mount that fits between the radiator and a tie bar on the vehicle frame.

U.S. Pat. No. 4,742,881 for Radiator Attaching Apparatus relates to projections extending from the radiator that are retained in openings in the frame members by resilient supporting members.

U.S. Pat. No. 6,550,558 for Radiator Mounting relates to a spring clip that engages annular grooves in a resilient mounting bushing attached to the bottom of the radiator, and a bore in the frame support member.

U.S. Pat. No. 4,121,682 for Radiator Mounting of a Vehicle, Especially of a Motor Vehicle, relates to a spring clamp holding the top of the radiator to a frame member.

U.S. Pat. No. 6,675,921 for Vehicle Radiator Support Structure relates to a non-metallic mounting bracket with vibration isolators in openings that fit over mounting pins extending from the upper portion of the radiator.

U.S. Pat. No. 5,291,961 for Mounting Arrangement for a Radiator relates to a leaf spring that holds a pair of pins extending from the side of the radiator.

U.S. Pat. No. 3,700,061 for Elastic Mounting of a Radiator for Motor Vehicles relates to a damping rail extending over the entire height of the radiator, and a spring clip holding the top of the radiator.

U.S. Pat. No. 4,604,015 for Means for Retaining A Radiator Rigid relates to a cross rod attached to the corner gusset plate of a radiator to hold the radiator rigid.

U.S. Pat. No. 5,558,310 for Radiator Support Bracket relates to a bracket made from a polyamide resin with a base portion attached to the vehicle frame, a transformable arm portion that extends from the base portion, and an arched support portion that holds the upper side of the radiator.

Additionally, a stopper member that may be made from a metal plate covers the bracket.

U.S. Pat. No. 4,773,496 for Radiator Fastening Arrangement for Internal Combustion Engines, Especially in Motor Vehicles, relates to one-piece plastic molded parts that are elastically prestressed and detent-like connected to the body and radiator.

U.S. Pat. No. 4,564,168 for Upper Support for Radiator relates to a bracket that includes a bracket fastened to the car body and another bracket pressure contacted with the upper tank of the radiator, with both brackets joined together by a rubber member.

While some of these radiator mountings have been used in automobiles or tractors, they are less useful for off-road utility vehicles primarily due to cost issues. Instead, many utility vehicles minimize radiator mounting cost by using sheet metal brackets secured with threaded fasteners between the top tank of the radiator and a vehicle frame member, and between the bottom tank and a lower frame member. Surfaces of the radiator may be covered with resilient foam to help insulate the radiator from shocks to the frame, and to compensate for tolerances that may vary between the components.

However, there is a continuing need to further reduce the cost required to mount a radiator in a utility vehicle, the parts count for the mounting arrangement, and the assembly time needed for mounting the radiator. A radiator mounting arrangement for a utility vehicle is needed that is inexpensive, requires few parts and is fast and easy to assemble.

SUMMARY OF THE INVENTION

A radiator mounting arrangement on a utility vehicle includes a wire form fastened to a frame member of the utility vehicle, a plurality of integrally molded features in a top tank of a radiator, the wire form held between the integrally molded features without separate fasteners to prevent the radiator from moving fore and aft, or side to side. The radiator mounting arrangement is inexpensive, requires few parts and is fast and easy to assemble.

DESCRIPTION OF THE PREFERRED EMBODIMENT

Figure 1:
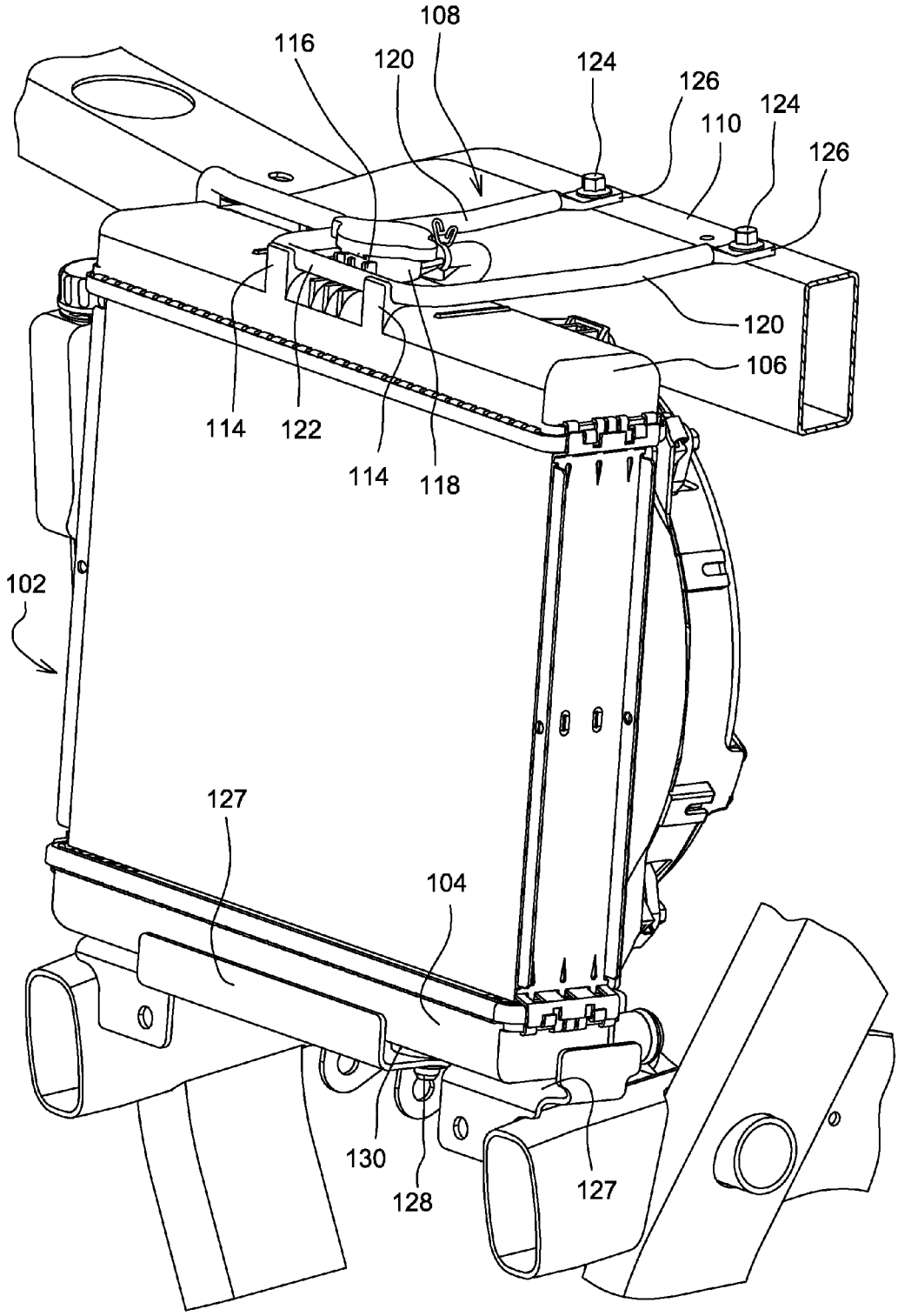
FIG. 1 is a perspective view of a radiator mounted on a utility vehicle according to a first embodiment of the invention.
Figure 2:
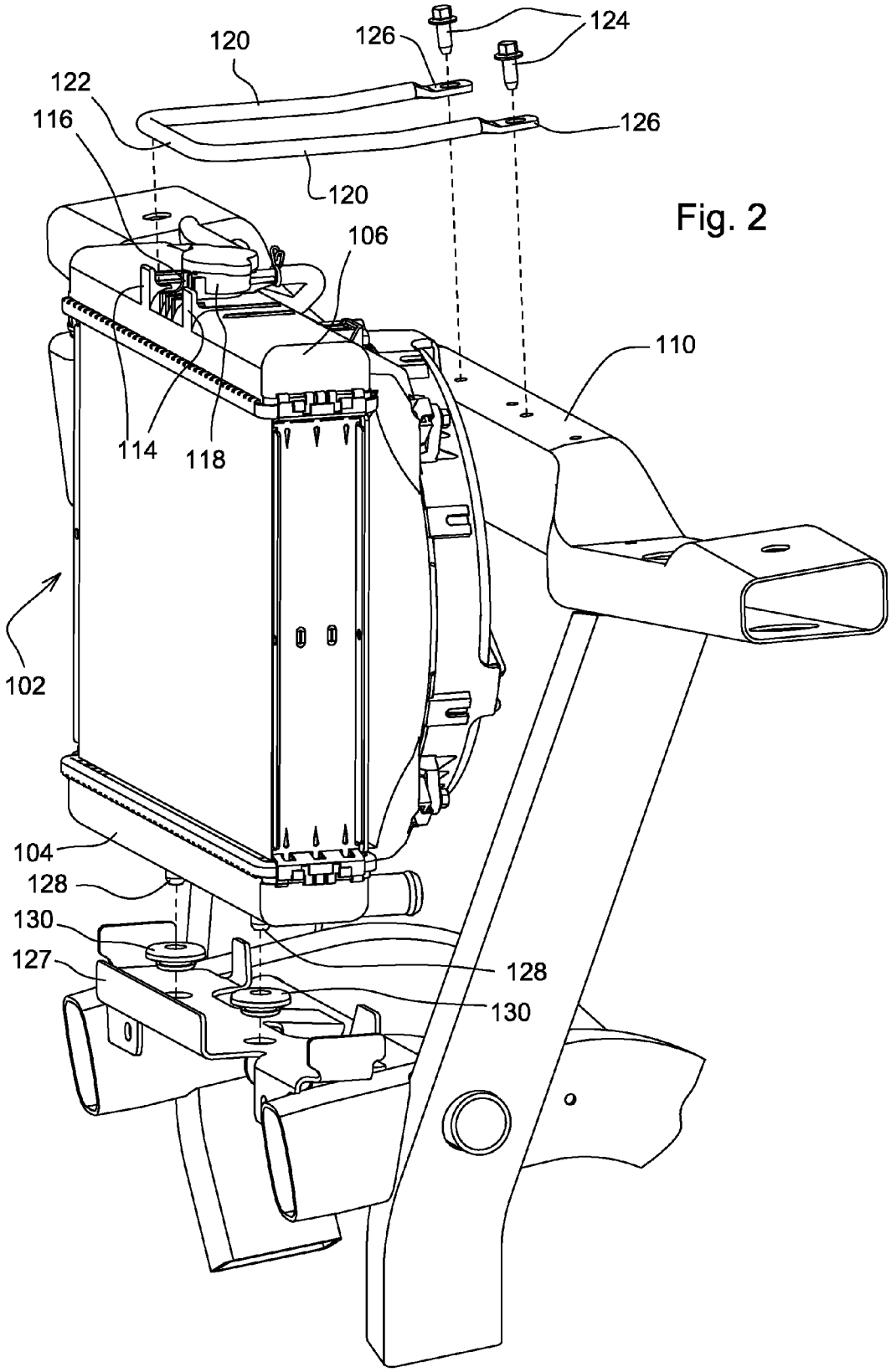
FIG. 2 is an exploded perspective view of a radiator mounting arrangement on a utility vehicle according to the first embodiment.
Figure 3:
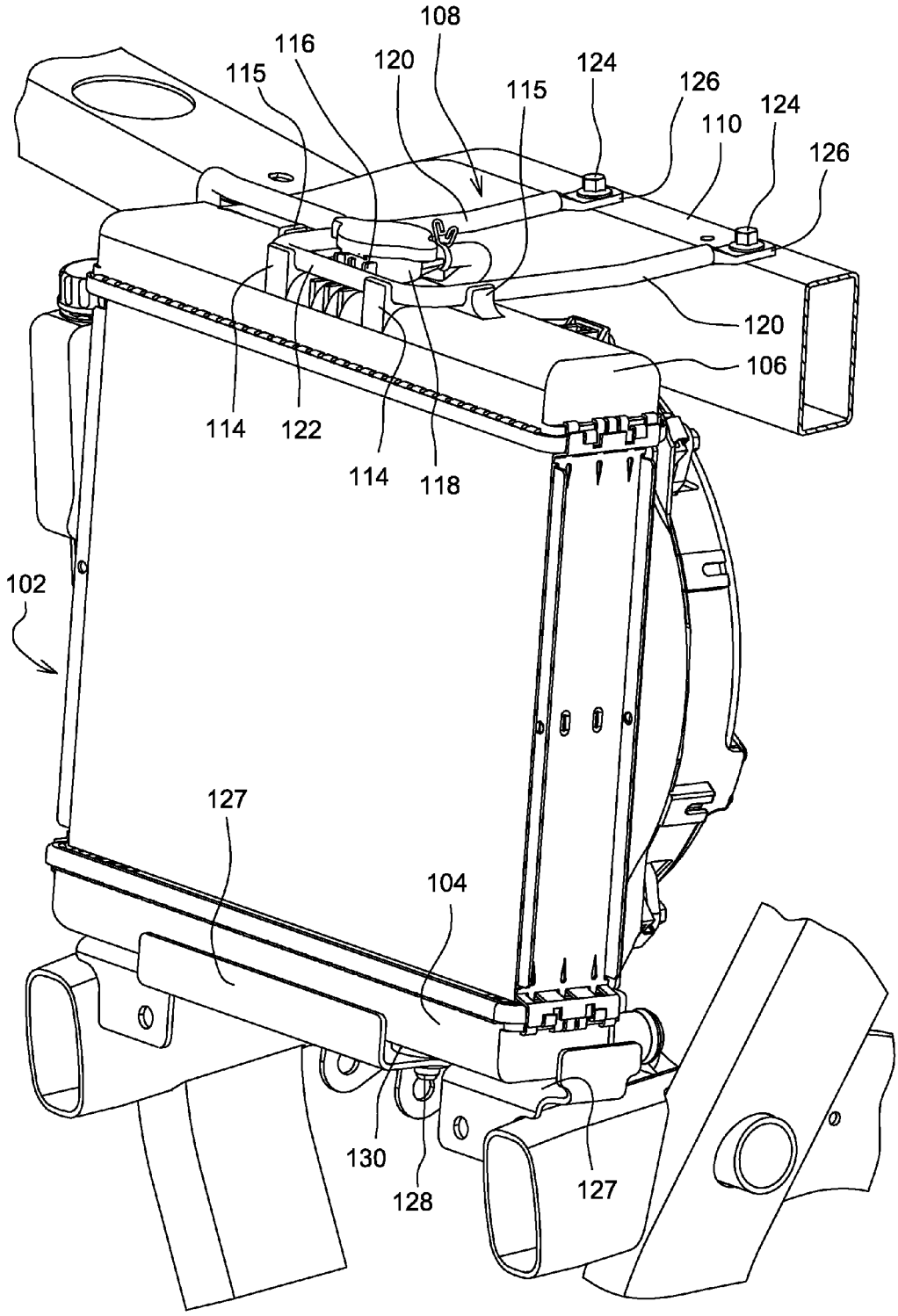
FIG. 3 is a perspective view of a radiator mounted on a utility vehicle according to a second embodiment of the invention.

FIGS. 1-3 show radiator 102 which includes bottom tank 104 and top tank 106, both of which are injection molded plastic. The top tank of the radiator is mounted to a utility vehicle frame using wire form 108 that extends between upper frame member 110 of the utility vehicle and top tank 106. Wire forms are made from round wire that is manipulated or bent into desired shapes having specified angles and lengths. Wire forms are typically made out of cold drawn steel. Wire forms that may be used in the radiator mounting arrangement of this invention typically ranges from about 6 mm in diameter up to about 12 mm in diameter.

In one embodiment, wire form 108 may be fastened to the top tank by engaging with one or more features that are integrally molded into the top tank. The integrally molded features prevent the radiator from moving vertically, fore and aft and/or side to side, without requiring any fasteners between the wire form and top tank.

In a first embodiment shown in FIGS. 1 and 2, the integrally molded features may include a pair of posts 114 extending upwardly from the forward facing or front surface of the top tank. The length of the posts may be greater than the wire form diameter. Additionally, the integrally molded features may include one or more supporting ribs 116 that extend upwardly from the surface of the top tank. The supporting ribs are positioned between posts 114 and fill opening 118 on the top tank.

In the first embodiment, the posts and supporting ribs together provide a channel molded into the upper surface of the top tank. The channel may be dimensioned to fit a straight section of wire form 108 without use of any metal screws or other fasteners to secure the top tank to the wire form. Alternatively, instead of a channel, the integrally molded features may include one or more holes in a vertical wall molded into and extending upwardly from the top tank. A section of the wire form may be inserted and held in the holes without requiring separate fasteners to the top tank.

In the first embodiment, once wire form 108 is inserted and positioned between the posts and ribs on the top tank, the radiator is secured against moving fore and aft. Additionally, the installed wire form may be biased to provide a downward force against the top tank to help hold the top tank in place. The wire form also may flex sufficiently to accommodate thermal expansion or other movement of the radiator and frame relative to each other during operation of the utility vehicle.

In a second embodiment shown in FIG. 3, the integrally molded features may include a pair of posts 115 extending upwardly from the top tank on either side of the wire form. The length of the posts may be greater than the wire form diameter. The integrally molded features also may include supporting ribs 116 that extend upwardly from the surface of the top tank. Once wire form 108 is inserted and positioned between the posts, the radiator is secured against moving side to side. Additionally, the installed wire form may provide a downward force against the top tank to help hold the top tank in place. The wire form also may flex sufficiently to accommodate thermal expansion or other movement of the radiator and frame relative to each other during operation of the utility vehicle.

In one embodiment, wire form 108 may be generally U-shaped, with two legs 120 and a midsection 122. The midsection may extend into a channel between the integrally molded features on the top tank. The legs may be fastened to frame member 110 next to the radiator using threaded fasteners 124 such as metal screws. The ends 126 of the legs may be flattened and may have holes therethrough for receiving the threaded fasteners.

In one embodiment, bottom tank 104 of the radiator may be mounted to lower frame member or plate 127 using two downwardly protruding posts 128 attached to the bottom tank. Each post may be inserted into a rubber grommet 130 which is assembled into a hole in the lower frame member or plate 127.

Having described the preferred embodiment, it will become apparent that various modifications can be made without departing from the scope of the invention as defined in the accompanying claims.

The invention claimed is:

1. A radiator mounting arrangement on a utility vehicle, comprising:

a wire form fastened to a frame member of the utility vehicle; and a plurality of integrally molded features providing a channel dimensioned to fit a U-shaped section of the wire form around a fill tube on a top tank of a radiator, the wire form held between the integrally molded features forwardly of the fill tube without separate fasteners to prevent the radiator from moving vertically.

2. The radiator mounting arrangement of claim 1 wherein the integrally molded features are located forwardly and rearwardly of the wire form to prevent the radiator from moving fore and aft.

3. The radiator mounting arrangement of claim 1 wherein the integrally molded features are located on either side of the wire form to prevent the radiator from moving side to side.

4. The radiator mounting arrangement of claim 1 wherein the wire form has first and second ends fastened to the frame member with threaded fasteners.

5. The radiator mounting arrangement of claim 1 wherein the integrally molded features include a pair of posts extending upwardly from the top tank.

6. The radiator mounting arrangement of claim 1 wherein the top tank and integrally molded features are injection molded plastic.

7. The radiator mounting arrangement of claim 1 wherein the wire form is biased downwardly against the top tank.

8. A radiator mounting arrangement on a utility vehicle, comprising:

an injection molded top tank and bottom tank;

a plurality of integrally molded features extending upwardly from the top tank; and a wire form connected to a frame member of the utility vehicle and engaging the integrally molded features without fasteners therebetween;

wherein the integrally molded features are a plurality of posts extending upwardly from the top tank, and a plurality of ribs adjacent a fill tube in the top tank;

and wherein the wire form is positioned between the posts and the ribs.

9. The radiator mounting arrangement of claim 8 wherein the wire form is U-shaped and the legs are connected to the frame member by threaded screws.

10. A radiator mounting arrangement on a utility vehicle, comprising:

a wire form extending between a top tank of the radiator and an upper frame member of the utility vehicle; the wire form positioned between a plurality of features integrally molded into the top tank and features on a fill tube extending from the top tank; the wire form captured in a channel between the features without fasteners therebetween; and a pair of posts extending from a bottom tank of the radiator through a pair of holes in a bottom support plate attached to a lower frame member of the utility vehicle.

11. The radiator mounting arrangement of claim 10 wherein the wire form is generally U-shaped and has each of its legs fastened to the upper frame member with threaded fasteners.

12. The radiator mounting arrangement of claim 10 wherein the top tank and bottom tank are injection molded plastic.

* * * * *